US006981349B1

(12) United States Patent
Martinez, Jr.

(10) Patent No.: US 6,981,349 B1
(45) Date of Patent: Jan. 3, 2006

(54) ROOF WATERPROOFING SYSTEM CONSISTING OF AN ORGANIC RESIN PROTECTED BY AN ALUMINUM-COPOLYMER COMPOSITE FOIL

(75) Inventor: Celso Martinez, Jr., Sao Carlos (BR)

(73) Assignee: Fundacao de Amparo a Pesquisa de Estado de Sao Paulo, Sao Paulo (BR)

( * ) Notice: Subject to any disclaimer, the term of this patent is extended or adjusted under 35 U.S.C. 154(b) by 0 days.

(21) Appl. No.: 09/490,740

(22) PCT Filed: Jul. 28, 1998

(86) PCT No.: PCT/BR98/00053

§ 371 (c)(1),
(2), (4) Date: Jan. 25, 2000

(87) PCT Pub. No.: WO99/06646

PCT Pub. Date: Feb. 11, 1999

(51) Int. Cl.
*E04B 5/00* (2006.01)

(52) U.S. Cl. ..... 52/409; 52/58; 52/741.3; 52/741.4

(58) Field of Classification Search ..... 52/302.1, 52/58, 169.14, 408, 409, 741.3, 741.4
See application file for complete search history.

(56) References Cited

U.S. PATENT DOCUMENTS 5,142,837 A * 9/1992 Simpson et al. ..... 52/409

* cited by examiner

*Primary Examiner*—Naoko Slack
(74) *Attorney, Agent, or Firm*—Charles S. Guenzer

(57) ABSTRACT

A roofing system including two techniques that confer water tightness to exposed substrates, whether cimentious or not, used on roofs of current buildings. The system increases reliability of the surfaces against the percolation of water. The system includes the process of applying, on exposed porous or non-porous surfaces (1), mud slab, regularized or not, of concrete, wood, metals, etc., on top of baseboards or parapets (2), a high adherence organic resin (4), that is self-leveling, visco-elastic, thermoplastic and hydrophobic, covered by film strips (5) of aluminum laminated with thermoplastic copolymers, thermally welded at its overlaps (7) by a thermal process and fastened in the vertical surfaces of the structures by groups (6) of screws, plastic washers, and expansion shells. The flow of rain water is guided by pipelines (3) of PVC or other equivalent material.

15 Claims, 1 Drawing Sheet

ROOF WATERPROOFING SYSTEM CONSISTING OF AN ORGANIC RESIN PROTECTED BY AN ALUMINUM-COPOLYMER COMPOSITE FOIL

FIELD OF THE INVENTION

The present invention is related to the protection of exposed building roofs consisting of a cementitious or non-cementitious substrate against percolation of water that combines in one system two techniques that confer watertightness to the roof, providing larger reliability to the surfaces against the percolation of water.

BACKGROUND OF THE INVENTION

At present, the factory-prepared systems which are intended to provide watertight roofs (except the conventional roofs of clay tile, fiber-cement or metallic elements) are mainly constituted of prefabricated asphalt-based, asphalt-elastomeric or pure elastomeric impermeable films.

The factory-prepared asphalt-based and asphalt-elastomeric sheets have usually an internal reinforcement provided by polyethylene films, non-woven polyester or non-woven fiberglass. Elastomeric films, particularly the fluid-applied elastomers, do not usually contain reinforcement in their interior although some polymeric manufactured sheets do include reinforcement to provide added strength and puncture resistance to the films. These films are applied on a structural substrate (e.g. concrete slabs), sometimes regularized by cimentitious mortar. The mortar is used to create a surface free from sharp angular projection and depressions besides providing suitable slope for water flow.

Some of these materials are applied to the mud slab through previous application of an appropriate asphalt-based primer used to fix the films strongly to the mud slab substrate. The primer is applied cold, but the film is attached to the primer, often times, through a hot process, such as by means of a torch.

In order to protect the films against the deleterious effects of ultraviolet (UV) rays, some roofing materials include in one of their faces an element to impede such UV effects on the underlying asphalt-based materials. Usually, this UV shielding element comprises an appropriate elastomer. "A waterproofing laminate suitable for use in roofs, floors, or other surfaces where waterproofing is desired, comprises an elastomeric sheet secured to a modified bitumen layer and a release sheet secured to the modified bitumen layer. Certain preferred materials for used in the laminate are recited." (U.S. Pat. No. 4,775,567). The UV shielding element may alternatively comprise crushed slate powder or a thin aluminum film facing that surfaces one side of the asphalt-based sheet.

These prefabricated sheets are often used for roofs with continued or sporadic traffic, usually necessary for maintenance or cleaning. Such facing materials do not give mechanical protection to the sheets, even though they do protect them against the incidence of ultraviolet solar rays. On the other hand, infrared rays are also reflected by the aluminum facing, improving thermal protection for the environment protected by the faced sheets.

There are also factory-prepared asphalt-elastomeric membranes, in which one face presents a self-adhesive finish and the other face receives, as in the previous case, a thin film facing of aluminum. As disclosed in U.S. Pat. Nos. 4,936,938, 5,096,759, and 5,142,837, a laminated roofing material includes an aluminum foil top sheet laminated to a polyethylene film by an ionomer resin. After the sheets are bonded together they are cooled to set the resin and an asphalt (bitumen) coating is applied to the exposed polyethylene sheet and covered with a release paper. The roofing material is applied over an underlayment to form a roof supported by conventional sheeting material.

Such a material has several applications in the building construction industry, as for example, the repair of metal roofs which leak due to oxidation and consequent perforation of the roof metallic cover. In this case, additional primers are not used because one of the material faces is already adhesive provided that the substrate is absolutely clean and dry to promote attachment.

The main disadvantage in the case of the aluminum-faced membranes resides in the low mechanical resistance of the coating on the exposed face. As the aluminum film is extremely thin (about 35 to 50 micrometers), it is subject to the damaging mechanical effects which may expose the asphalt-based portion of the membrane to the UV solar rays.

Another quite common occurrence in the usage of asphalt-based or elastomeric sheets to build construction roofs is the difficulty in locating eventual defects that could lead to the failure of water tightness. The infiltration can be caused by a flaw in lateral or longitudinal welding of the membrane strip overlaps or even by involuntary perforation in the sheet. Water penetrates through the flaw, reaches the mud slab and percolates into the interior of its porous matrix under the roofing membrane, until it finds a defect in the cimentitious substrate (e.g. a joint, a "bug hole"), making the leakage visible on the inside of the building. Most of the time, the point at which the leakage becomes visible does not coincide with the position of the failure which caused the leak. Moreover, as primer attaches the sheet firmly to the deck, if a dynamic crack appears in the substrate due to structural movements (e.g. severe climatic thermal gradients), the new joint will probably propagate to the roofing material, splitting it at this position and allowing water to enter the split.

SUMMARY OF THE INVENTION

With the objective of solving such inconveniences, the present system was developed, through which substrate watertightness is assured by two processes. First, an organic, flexible, hydrophobic, self-leveling and visco-elastic composition resin is applied directly on the structural substrate to be treated, sealing the pores in its surface. Second, an impermeable aluminum foil laminated with thermoplastic copolymers is adhered to the surface by the organic resin.

The advantages of this system when compared to the existing ones are as follows. (a) It offers relatively large resistance to involuntary mechanical injuries on the foil, due to the presence of larger film thickness (about 300 micrometers). (b) Its water tightness results from two different processes; in the event that a severe mechanical accident perforated the foil, the structure will stay tight as its pores remain sealed by the organic resin action. (c) The system permits its being applied directly over the concrete deck structure, eliminating the need of previous deposition of a mud slab, which is indispensable in the prevalent waterproofing systems, thereby leading to greater economic feasibility. (d) The system can also be applied over mud slabs substrates, although direct application on concrete deck structure is preferable. (e) It promotes the ease and economy in locating leak-causing flaws during flood testing if the proposed system is applied directly on the concrete deck structure. (f) The resin, being visco-elastic, allows reasonable adherence of the film composite to the substrate, admitting the possibility of small sliding motion between them. This characteristic is responsible for the integrity of the film if a dynamic crack arise on the deck as such crack is not transmitted to the film since it slides on the resin layer without breaking, in distinction to asphaltic or asphalt-elastomeric sheets which are intimately stuck to the substrate by means of primers.

DETAILED DESCRIPTION OF THE PREFERRED EMBODIMENTS

Figure 1:
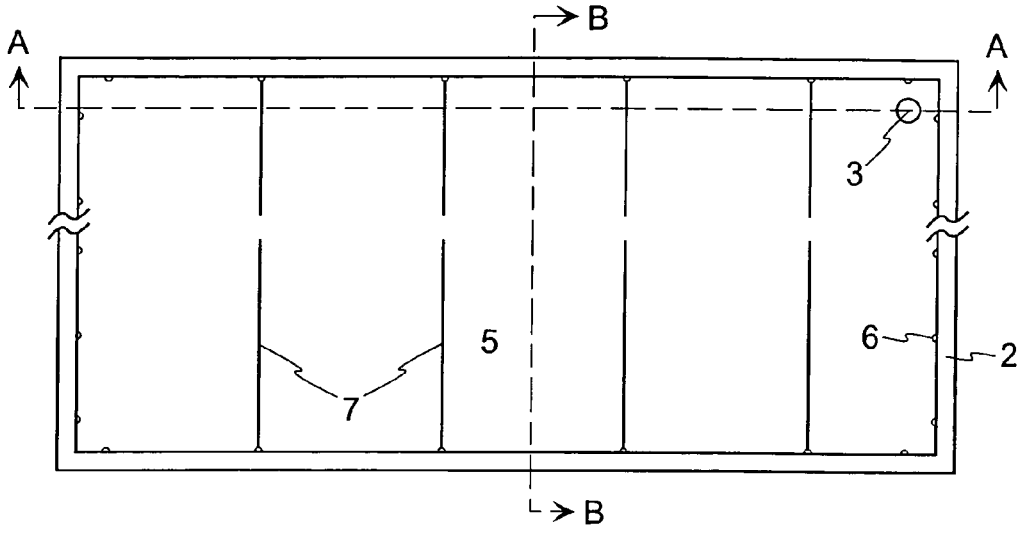
FIG. 1 shows the plan of a surface on which the proposed system is applied.
Figure 2:
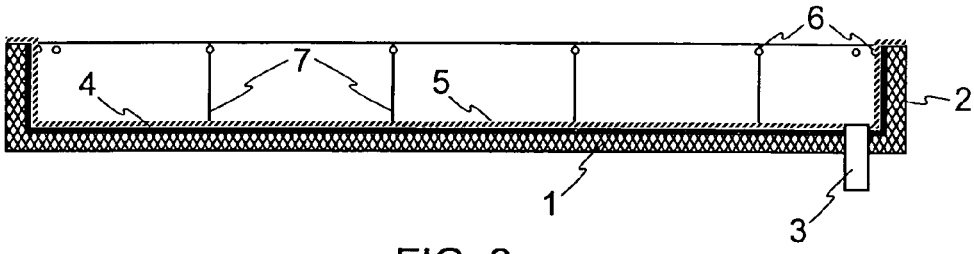
FIG. 2 shows the longitudinal section of a surface on which the proposed system is applied.
Figure 3:
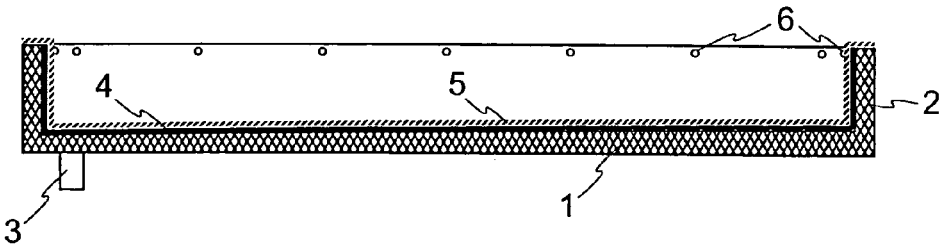
FIG. 3 shows the traverse section of a surface on which the proposed system was applied.

With regard to these illustrations, it can be observed that the organic resin 4 is applied over the deck structure 1 and its baseboards or parapets 2. This resin 4 has high attachment power to porous and non-porous substrates, besides having self-leveling, hydrophobic and viscoelastic characteristics. In the specific case of the porous substrates, the material sticks to the surface, penetrating the external capillaries of the porous matrix and sealing them. Therefore, this material renders the porous surface totally impervious to water and, as the resin is highly flexible, it allows small structural movements in the deck without losing water tightness.

Over the substrate, previously treated with the mentioned resin, a composite film or foil 5 of aluminum laminated on both faces with thermoplastic copolymers is applied in a way so as to protect the resin 4 against the harmful action of ultraviolet solar light. Welding 7 of the several strips of the composite, in the longitudinal direction, is done by the application of heated air, through appropriate equipment and temperature, in the overlapping interface of two adjacent strips of the composite films 5. The copolymer which laminates the aluminum foil is thermoplastic and allows it to be melted with heated air, attaching the adjacent sheets on the overlapping strip. No bonding materials are needed for this purpose.

Screws 6 are advantageously used to fasten the edges of the composite strip to the deck. The screws 6 together with plastic washers are attached in common expansion shells that are introduced inside appropriate holes 6 preformed in the structure of the baseboards and parapets 2.

The rain water, collected on the treated surface, flows through a drain pipe 3 in PVC or other material used for that purpose.

What is claimed is:

1. A waterproofed roofing system for application over a roof surface, comprising:

an adhesive organic resin layer not containing asphalt and applied over said roof surface, said resin layer being visco-elastic after completion of said system; and a composite film applied to said resin and including a central aluminum layer laminated between respective thermoplastic copolymer layers.

2. The roofing system of claim 1, wherein said resin layer allows sliding motion between said composite foil and said roof surface when said roof system is ready to use.

3. The roofing system of claim 1, wherein said roofing surface comprises concrete and said resin layer is applied directly to said concrete.

4. The roofing system of claim 1, wherein said roofing surface comprises a mud slab layer and said resin layer is applied directly to said mud slab layer.

5. The roofing system of claim 1, wherein said roofing surface includes a porous matrix having capillaries into which said resin layer penetrates.

6. The roofing system of claim 1, comprising a plurality of strips of said composite film applied over said resin layer and having overlapping edges welded together.

7. The roofing system of claim 1, wherein said roofing surface includes a parapet and further comprising screws fastening an edge of said composite film to said parapet.

8. A roofing method, comprising the steps of:

a first step of applying over said roof surface an adhesive organic resin layer not containing asphalt;

a subsequent second step of applying over said resin layer a strip of a composite foil including a central aluminum layer laminated between respective thermoplastic copolymer layers.

9. The roofing method of claim 8, wherein said roofing surface includes a parapet and further comprising fastening an edge of said strip to said parapet with mechanical fasteners.

10. The roofing method of claim 9, wherein said resin layer is visco-elastic after said fastening step.

11. The roofing method of claim 8, wherein said second step applies over said resin layer a plurality of said strips having respective edges overlapping.

12. The roofing method of claim 11, further comprises heating at least one of said overlapping edges to thereby attach adjacent ones of said strips.

13. The roofing method of claim 12, wherein said heating step includes applying heated air.

14. The roofing method of claim 12, wherein said heating step melts said thermoplastic copolymer layers of said adjacent ones of said strips, thereby welding them together.

15. The roofing method of claim 8, wherein said resin layer is visco-elastic after said method has been completed.

* * * * *